United States Patent [19]

Abramson

[11] 4,031,665

[45] June 28, 1977

[54] ADJUSTABLE ENTRANCE DOOR

[76] Inventor: Harold B. Abramson, 30 Stearns Road, Brookline, Mass. 02146

[22] Filed: Dec. 8, 1975

[21] Appl. No.: 638,370

[52] U.S. Cl. ..... 49/501; 49/488; 49/505

[51] Int. Cl.² ..... E06B 1/04; E06B 3/00

[58] Field of Search ..... 49/501, 505, 488; 52/624, 627, 291

[56] References Cited

UNITED STATES PATENTS

| | | | |
|---|---|---|---|
| 1,799,423 | 4/1931 | Hubbert | 52/455 X |
| 2,644,554 | 7/1953 | Katz | 49/503 X |
| 2,739,674 | 3/1956 | Casebolt | 49/505 |
| 3,358,402 | 12/1967 | Sahm | 49/488 X |
| 3,380,194 | 4/1968 | Biro | 49/488 X |
| 3,458,955 | 8/1969 | Brooks | 49/501 X |

FOREIGN PATENTS OR APPLICATIONS

| | | | |
|---|---|---|---|
| 511,221 | 3/1955 | Canada | 49/501 |
| 1,484,188 | 5/1967 | France | 49/501 |
| 1,316,453 | 5/1973 | United Kingdom | 49/501 |

*Primary Examiner*—Ramon S. Britts
*Attorney, Agent, or Firm*—Morse, Altman, Oates, & Bello

[57] ABSTRACT

An adjustable entrance door with a plurality of extruded sections that are interconnected with tie rods to form a rectangular frame in which a glass panel is mounted. The extruded sections include a lead edge stile, a hinge stile, a top rail and a bottom rail, the tie rods extending through the rails and into the stiles. The top rail is provided with a block that engages the top edge of the panel for relative vertical movement of the lead edge stile and hinge stile. The bottom rail is fitted with an adjustable member that extends the width of the door and is vertically movable for alignment with a threshold.

10 Claims, 15 Drawing Figures

ADJUSTABLE ENTRANCE DOOR

BACKGROUND OF THE INVENTION

1. Field of the Invention

The present invention relates to doors and, more particularly, is directed towards entrance doors having interconnected extruded sections.

2. Description of the Prior Art

Entrance doors of various configurations have been fabricated from a plurality of precut extruded sections that are welded together to form a rigid structure. In a conventional manner, a door frame which corresponds generally to the entrance door configuration is secured in place. Then, the entrance door is hung on the door frame. At times, for various reasons, the entrance door does not properly mate with the door frame. In such cases, due to the rigid construction of the entrance door, shims are used to adjust the door frame opening so that it will correspond to the entrance door configuration. A need has arisen for an entrance door that can be adjusted to compensate for variations between the door and door frame.

SUMMARY OF THE INVENTION

It is an object of the present invention to provide an entrance door that is adjustable for proper mating with a door frame. The adjustable entrance door is characterized by a plurality of extruded sections that are interconnected to form an opened rectangular frame in which a rectangular glass panel is mounted. The extruded sections include a lead edge stile, a hinge stile, a top rail and a bottom rail. Tie rods, which extend through each rail and into each stile, are provided for interconnecting the extruded sections. An inner face of each extruded section is configured to captively hold a pair of interlocking glazing beads, the glass panel being secured between the beads with the edges of the panel askew with respect to the inner edges of the rectangular frame. The top rail is provided with a block that engages the top edge of the glass panel for relative vertical movement of the lead edge stile and hinge stile. The bottom rail is fitted with an adjustable member that extends the width of the door and is vertically movable for mating alignment with a threshold.

It is another object of the present invention to provide an adjustable entrance door in which the lead edge stile is formed with an integral lip that overlaps a doorjamb for security and weather protection.

Other objects of the present invention will in part be obvious and will in part appear hereinafter.

The invention accordingly comprises the devices, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein:

FIG. 9 is a sectional view of the other section of the glazing bead taken along the lines 9—9 of FIG. 2;

DETAILED DESCRIPTION OF THE PREFERRED EMBODIMENTS

Figure 1:
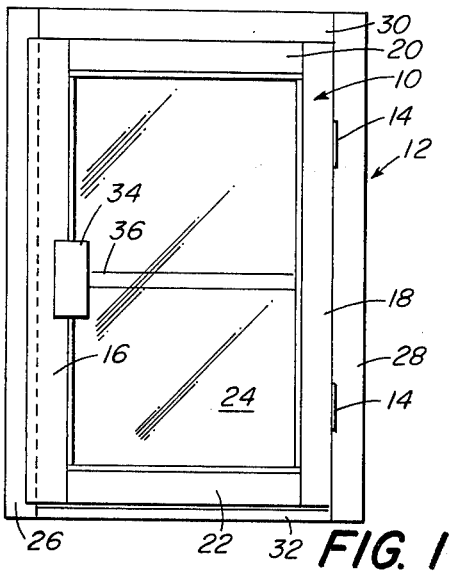
FIG. 1 is a front elevation of an entrance door embodying the invention.

Referring now to the drawings, particularly FIG. 1, there is shown an outwardly opening entrance door 10 which is hung on a door frame 12 by means of hinges 14, for example butt hinges. Door 10 comprises a plurality of extruded sections including a lead edge stile 16, a hinge stile 18, a top rail 20 and a bottom rail 22 which are interconnected to form a substantially rectangular frame in which a panel 24, for example a glass panel, is captively held. Door frame 12 comprises a plurality of extruded sections including side jambs 26, 28, a header 30 and a threshold 32 which are interconnected to form a substantially rectangular open frame. In the following description, the sides of each extruded section of door 10 are denoted as inner, outer, interior and exterior. The inner sides of the extruded sections face one another, glass panel 24 being in juxtaposition with the inner sides. The outer sides are opposite the inner sides. The exterior sides of the extruded section are on the outside of the door and the interior sides are on the inside of the door opposite the exterior sides. The extruded sections of door 10 and frame 12 are composed of an aluminum alloy having a hard, highly resistant thermoset coating. Preferably, the extruded sections are composed of an aluminum alloy consisting essentially of approximately 0.4 percent silicon, 0.7 percent magnesium and 98.9 percent aluminum and having an aluminum Associated alloy designation 6063-T5 as specified in the Aluminum Association Standardized System of Alloy Designation adopted October, 1954. The nominal thickness of the extruded sections is approximately 3.2 mm (0.125 inches). The thermoset coating is an acrylic resin with amide side chains copolymerized from styrene and ethyl acrylate.

Figure 2:
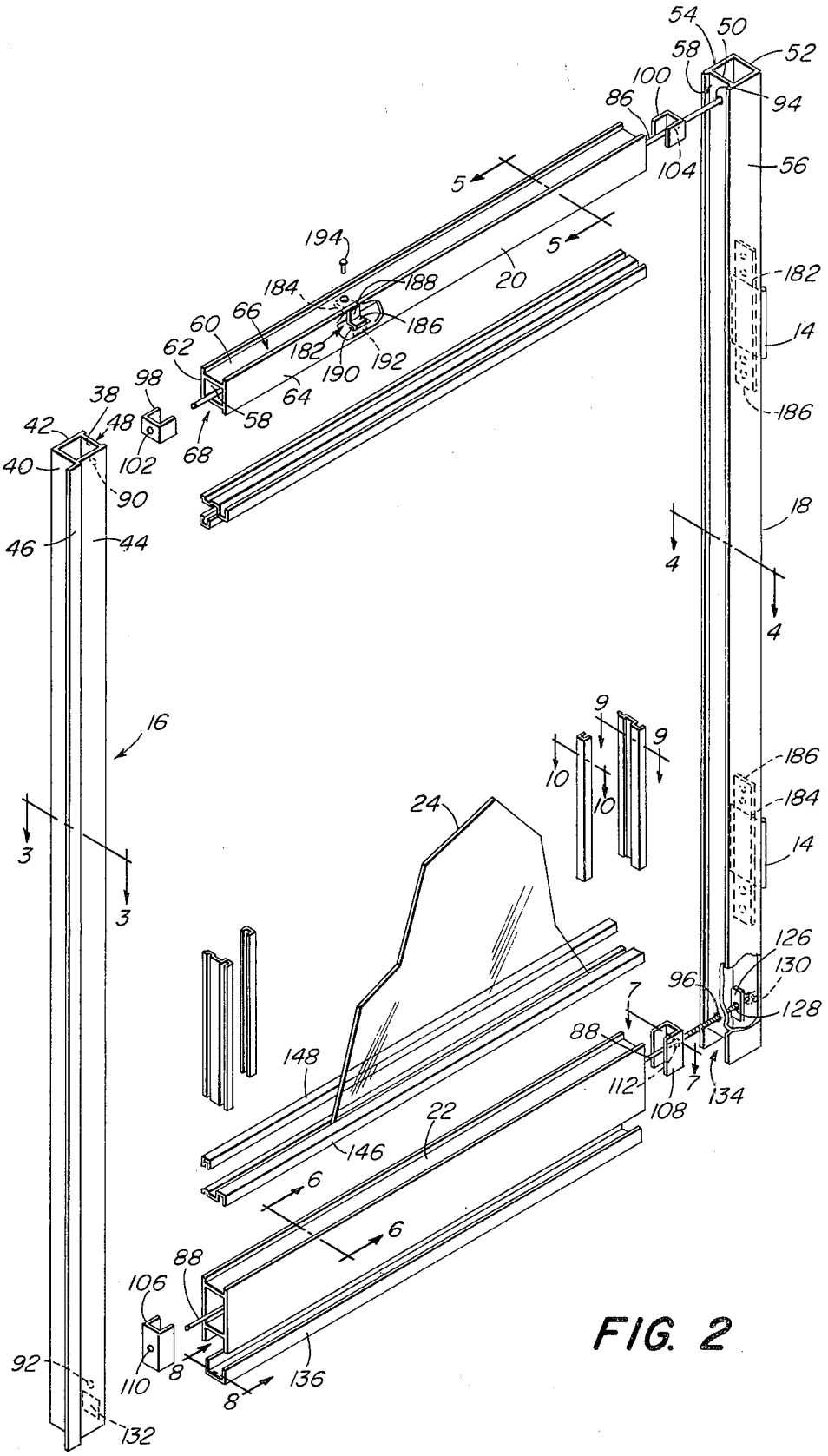
FIG. 2 is an exploded view in perspective of the entrance door of FIG. 1.

In the embodiment of FIG. 1, hinges 14 are mounted to hinge stile 18 and side jamb 28 in such a way that door 10 swings outwardly. A pull handle 34 is fastened to the exterior side of lead edge stile 16. A push bar 36 is mounted between lead edge stile 16 and hinge stile 18 on the interior face thereof. A lock mechanism 37 is mounted to lead edge stile 16. The detail construction of entrance door 10 is shown in FIG. 2. The cross sectional profiles of lead edge stile 16, hinge stile 18, top rail 20 and bottom rail 22 are shown in FIGS. 3, 4, 5 and 6, respectively.

Figure 3:
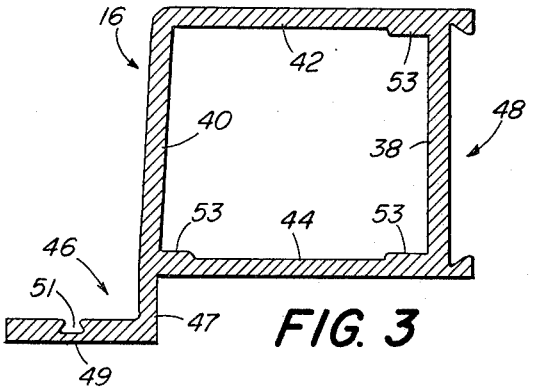
FIG. 3 is a sectional view of the lead edge stile taken along the lines 3—3 of FIG. 2.

Referring now to FIGS. 2 and 3, it will be seen that lead edge stile 16 comprises an inner side 38, an outer side 40, an interior side 42, an exterior side 44 and an extending flange 46. Inner side 38, outer side 40, interior side 42 and exterior side 44 have a generally trapezoidal profile in right cross section. Interior side 42 and exterior side 44 are in spaced parallel relationship to one another, the exterior side being wider than the interior side. Inner side 38 is in perpendicular relationship to interior side 42 and exterior side 44. Outer side 40 diverges inwardly towards inner side 38 from exterior side 44 to interior side 42. One edge of outer side 40 is flush with one edge of interior side 42. The other edge of outer side 40 extends beyond one edge of exterior side 44 and terminates in flange 46 which includes a shoulder 47 and an arm 49. Shoulder 47 is parallel to inner side 38 and arm 49 is parallel to exterior side 44. A mortise 51, which is formed at a medial portion of arm 49 at the interior side thereof, is configured to receive a weather strip (not shown). Flange 46, which overlaps side jamb 26 when door 10 is closed, provides security and weather protection. The other edges of interior side 42 and exterior side 44 extend beyond the edges of inner side 38 to form a mortise 48. As shown at 53, the inner faces of exterior side 44 and interior side 42 are thickened for support at the union of inner side 38 and exterior side 44, at the union of inner side 38 and interior side 42, and at the union of outer side 40 and exterior side 44.

Figure 4:
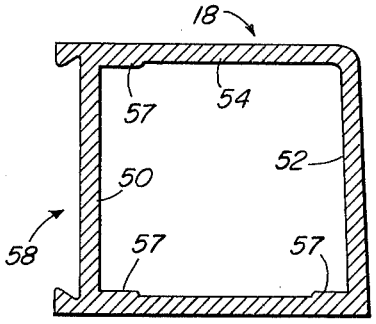
FIG. 4 is a sectional view of the hinge stile taken along the lines 4—4 of FIG. 2.

Referring now to FIG. 4, it will be seen that hinge stile 18 has a substantially trapezoidal profile in right cross section and includes an inner side 50, an outer side 52, an interior side 54 and an exterior side 56. Interior and exterior sides 54 and 56 are parallel to one another and are perpendicular to inner side 50. One edge of interior side 54 extends beyond one edge of inner side 50 and one edge of exterior side 56 extends beyond the other edge of inner side 50 to form a mortise 58. The other edges of interior side 54 and exterior side 56 are flush with opposite edges of outer side 52. The width of exterior side 56 is greater than the width of interior side 54, inner side 52 lying in a plane that diverges inwardly from exterior side 56 towards interior side 54. The inner faces of exterior side 56 and interior side 54 are thickened at 57 for support at the union of exterior side 56, inner side 50 and outer side 52, and at the union of interior side 54 and inner side 50.

Figure 5:
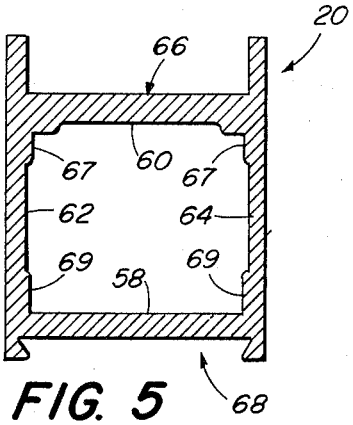
FIG. 5 is a sectional view of the top rail taken along the lines 5—5 of FIG. 2.

As shown in FIG. 5, top rail 20 has a substantially double I beam profile in right cross section and includes an inner side 58, an outer side 60, an interior side 62 and an exterior side 64. Inner side 58 and outer side 60 are parallel to one another and perpendicular to interior side 62 and exterior side 64. One edge of interior side 62 and one edge of exterior side 64 extend beyond the edges of outer side 60 to form a shallow, substantially U-shaped channel 66. The other edge of interior side 62 and the other edge of exterior side 64 extend beyond the edges of inner side 58 to form a mortise 68. As shown at 67, the inside corners formed at the union of outer side 60, interior side 62, and exterior side 64 are thickened for support. In addition, as shown at 69, the inner faces of interior side 62 and exterior side 64 are thickened for support at the union of inner side 58, interior side 62 and exterior side 64.

Figure 6:
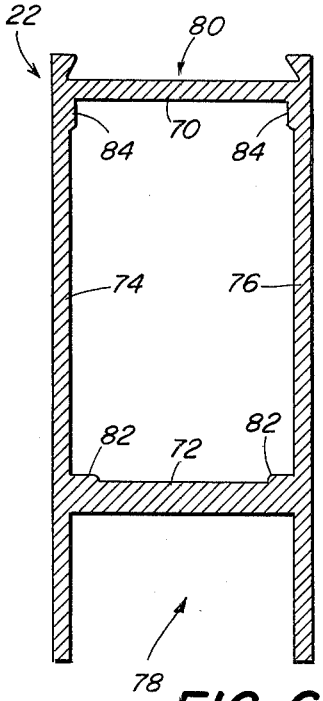
FIG. 6 is a sectional view of the bottom rail taken along the lines 6—6 of FIG. 2.

Referring now to FIG. 6, it will be seen that bottom rail 22 has a substantially A-shaped profile in right cross section and includes an inner side 70, an outer side 72, an interior side 74 and an exterior side 76. Inner side 70 and outer side 72 are parallel to one another and perpendicular to interior side 74 and exterior side 76. One edge of interior side 74 and one edge of exterior side 76 extend beyond the edges of outer side 72 to form a deep, substantially U-shaped channel 78. The other edge of interior side 74 and the other edge of exterior side 76 extend beyond the edges of inner side 70 to form a mortise 80. The inner faces of outer side 72 are thickened for support at 82, the union of outer side 72, interior side 74 and exterior side 76. Also, the inner faces of interior side 74 and exterior side 76 are thickened for support at 84, the union of inner side 70, interior side 74 and exterior side 76.

As previously indicated, lead edge stile 16, hinge stile 18, top rail 20 and bottom rail 22 are interconnected to form a rectangular frame by means of tie rods 86 and 88. The upper margin and the lower margin of inner side 48 of lead edge stile 48 are formed with holes 90 and 92, respectively. The upper margin and the lower margin of inner side 50 of hinge stile 18 are formed with holes 94 and 96, respectively. Holes 90 and 92 are in registration with holes 94 and 96, respectively. Registered holes 90 and 94 are configured to receive tie rod 86, for example a threaded rod and registered holes 92 and 96 are configured to receive tie rod 88, for example a threaded rod. Top rail 20 rests on a pair of brackets 98 and 100 which are fastened to the upper margins of lead edge stile 18 and hinge stile 20. Bracket 98 is formed with a through hole 102 which is in registration with hole 90 and bracket 100 is formed with a through hole 104 which is in registration with hole 94. Bracket 98 is positioned within mortise 48 and the edges of mortise 48 are crimped to secure bracket 98 thereto. In a similar manner, bracket 100 is crimped within mortise 58, hole 104 being in registration with hole 94. Bottom rail 22 rests on a pair of brackets 106 and 108 which are fastened to the lower margins of lead edge stile 18 and hinge stile 20. Bracket 106 is formed with a through hole 110 which is in registration with hole 92 and bracket 100 is formed with a through hole 112 which is in registration with hole 94. Brackets 106 and 108 are crimped within mortises 48 and 58 in the manner hereinbefore described in connection with bracket 98.

Figure 7:
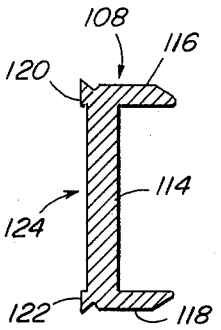
FIG. 7 is a sectional view of the bracket taken along the lines 7—7 of FIG. 2.

As shown in FIG. 7, bracket 108 is an extruded section having a C-shaped profile in right cross section and includes a base 114 and a pair of parallel legs 116, 118 that extend outwardly from one side of base 114 in perpendicular relationship thereto. The free ends of legs 116 and 118 are beveled inwardly. The other side of base 114 is provided with a pair of ribs 120 and 122 that define a flaring tenon 124 which is adapted to be snugly received within mortise 58. Brackets 108, 104 and 106 are identical in construction to bracket 98.

After the tenons of brackets 106 and 108 are inserted into their respective mortises to form a dovetail joint and are crimped therein, tie rod 88 is passed through bottom rail 22. Next, one end of tie rod 88 is passed through holes 112 and 96 into the interior of hinge stile 18. Next, bottom rail 22 is pressed into bracket 108 with legs 116 and 118 contacting the inner faces of interior and exterior sides 74 and 76 to prevent rotational movement of the bottom rail, the beveled ends of the legs facilitating reception of the bottom rail. Next, a rectangular washer 126, composed of steel for example, formed with a central hole 128 is placed on tie rod 88. Finally, a lock nut 130 is threaded onto tie rod 88. In a like fashion, the other end of bottom rail 18 is secured to lead edge stile 16. Top rail 20 is mounted to hinge stile 18 and lead edge stile 16 in a similar manner.

Figure 8:
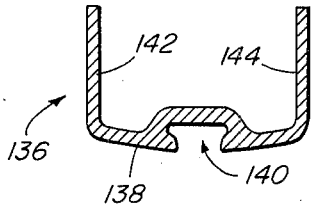
FIG. 8 is a sectional view of one section of the glazing bead taken along the lines 8—8 of FIG. 2.

As shown in FIG. 2, the bottom margins of lead edge stile 16 and hinge stile 18 are formed with substantially rectangular openings 132 and 134, respectively, which dimensionally correspond to and are in registration with channel 78. An adjustable leaf 136 is snugly received within channel 78 and openings 132, 134. Referring to FIG. 8, adjustable leaf 136 has a substantially U-shaped profile in right cross section and includes a base 138 which is formed with a mortise 140 and a pair of upright legs 142, 144. Mortise 140 is configured to receive a weather strip (not shown). Legs 142 and 144 press against the inner faces of interior side 74 and exterior side 76 of bottom rail 22 in such a manner that leaf 136 is constrained against free movement within channel 78 and is constrained for forced movement within channel 78.

Figure 10:
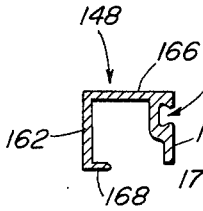
FIG. 10 is a sectional view of the adjustable expander taken along the lines 10—10 of FIG. 2.
Figure 11:
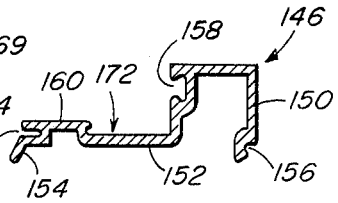

Glass panel 24 is captively held to door 10 by means of a pair of interlocking glazing beads 146, 148 that are snap-fitted into mortises 48, 58, 68 and 80. The details of glazing beads 146 and 148 are shown in FIGS. 9 and 10, respectively. Glazing bead 146 includes a body 150 having a substantially rectangular profile in right cross section and an extension member 152 which terminates in a tab 154. The lower portion of body 150 at the right hand side thereof as viewed in FIG. 9 is provided with a lock 156. Tab 154 and lock 156 are operative to hold glazing bead 146 to mortises 48, 58, 68 and 80. The left hand side of body 150 is formed with a mortise 158. Extension member 152 includes a strip 160 which constitutes a lock for glazing bead 148. As shown in FIG. 10, glazing bead 148 has a substantially rectangular profile in right cross section and includes a pair of upright members 162, 164, a connecting cross piece 166 and a tab 168. Upright member 164 is formed with a mortise 169 at an edge adjacent cross piece 166. Tab 168 extends from the lower edge of upright 162 towards the lower edge of upright 164 in parallel relationship to cross piece 166. Glazing bead 148 is captively held to glazing bead 146 by inserting tab 168 into an opening 170 formed between strip 160 and tab 154, the inner faces of uprights 162, 164 being in contact with the outer edges of strip 160.

Figure 11:
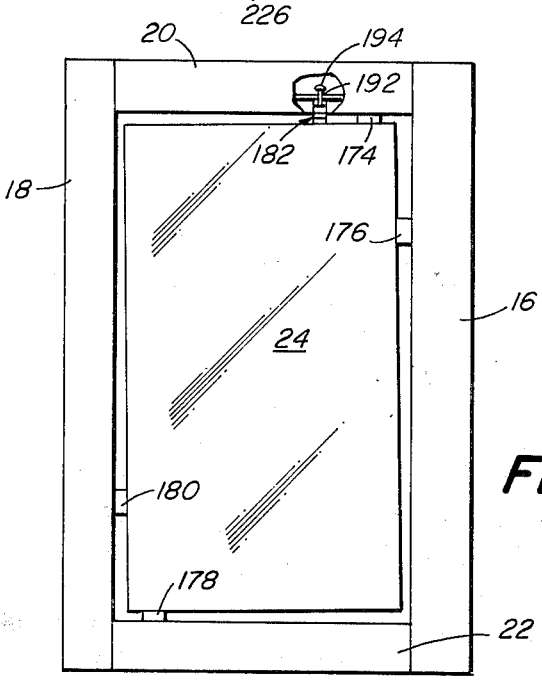
FIG. 11 is a front elevation of the entrance door of FIG. 1 with certain parts removed to show the lead edge stile and hinge stile adjustment.

In fabrication of entrance door 10, after lead edge stile 16, hinge stile 18, top rail 20 and bottom rail 22 are interconnected to form a rigid frame, glazing bead 146 sections are snapped into mortises 48, 58, 68 and 80, body 150 being on the exterior side of the door. Suitable packing (not shown) is placed in mortise 158. Glass panel 24 is inserted in a channel 172 formed in extension 152 between body 150 and strip 160. As viewed in FIG. 11, rubber shims 174, 176 and rubber shims 178, 180 are positioned adjacent the edges of glass panel 24 at the upper right hand corner and lower left hand corner of door 10, respectively. That is, shims 174 and 176 are positioned at the corner formed by top rail 20 and lead edge stile 16, shim 174 being closer to the corner than shim 176. Shims 178 and 180 are positioned at the corner formed by bottom rail 22 and hinge stile 18, shim 178 being closer to the corner than shim 180. The arrangement of shims is such that glass panel 24 is mounted obliquely with respect to the assemblage of lead edge stile 16, hinge stile 18, top rail 20 and bottom rail 22, the assemblage and panel being disposed in a common plane. The face of glass panel 24 is parallel to the faces of exterior sides 44, 56, 64 and 76, and is oblique with respect to the faces of inner sides 38, 50, 58 and 70. As viewed in FIG. 11, from the exterior side of door 10, glass panel 24 is tilted counterclockwise within the rectangular opening defined by the interconnected extruded sections of door 10, the edges of glass panel within channel 172. An adjusting lever or block 182, composed of a plastic such as a polyamide resin, rests on the upper edge of glass panel 24 adjacent shim 174. Adjusting block 182 has a step profile in right cross section and includes treads 184, 186 and riser 188, 190. Riser 190 projects through an opening 192 formed in inner side 58 of top rail 20 into contact with the upper edge of glass panel 24. A mover 194, for example a screw, is threaded into a hole 196 formed in outer side 60 of top rail 20, screw 194 being in contact with tread 184. As screw 194 is turned into hole 196, riser 190 presses against the edge of glass panel 24 and pulls lead edge stile 16 upwardly with respect to hinge stile 18. After glass panel 24 is in position, glazing beam 148 is snapped into glazing bead 146, tab 168 being received in opening 170 and the inner edge of upright 164 pressing against the edge of strip 160 nearest body 150. A suitable packing (not shown) is positioned in mortise 169.

As best shown in FIG. 2, outer side 52 of hinge stile 18 is formed with a pair of substantially rectangular openings 182 and 184, each of which is configured to snugly receive one leaf of hinges 14, the exposed face of the hinges being flush with the exposed face of inner side 52. Each hinge 14 is mounted to a back plate 186 by means of screws and the back plates, which are larger than openings 182 and 184, are fastened to outer side 52 by means of screws. After door 10 is hung on frame 12, screw 194 is turned to compensate for any misalignment between the top edge of door 10 and frame 12. Strip 160 is adjusted to compensate for any misalignment between the bottom edge of door 10 and frame 12.

Figure 12:
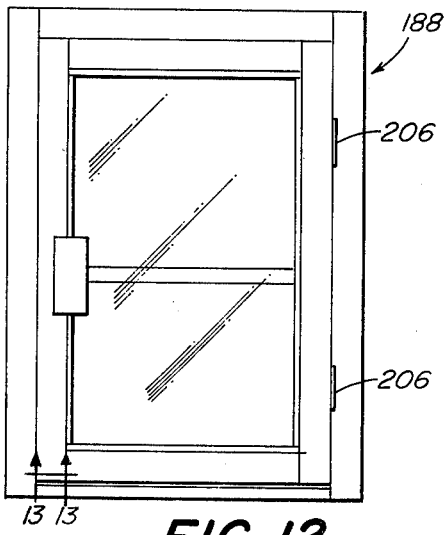
FIG. 12 is a front elevation of an alternative embodiment of the invention.
Figure 13:
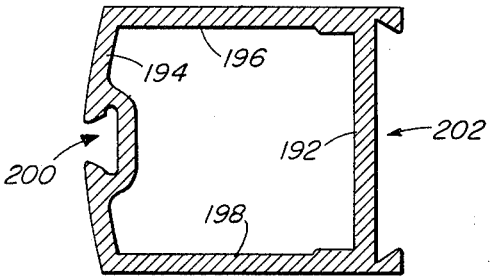
FIG. 13 is a sectional view of the lead edge stile taken along the lines 13—13 of FIG. 11.

An alternative embodiment of door 10 is shown in FIG. 12 at 188. The construction of door 188 is similar to door 10 and has like parts with the exception of flange 46. Door 188 includes an extruded lead edge stile 190 having a rectangular configuration as shown in FIG. 13. Lead edge stile 190 has an inner side 192, an outer side 194, an interior side 196 and an exterior side 198. Outer side 194 is bowed outwardly and is formed with a mortise 200 at a medial portion thereof for a weather strip (not shown). Interior side 196 and exterior side 198 are parallel to one another and perpendicular to inner side 192. A mortise 202, which corresponds to mortise 48, is provided on the inner face of inner side 192. The inner faces of interior side 196 and exterior side 198 are thickened for support at 204, adjacent the union of inner side 192, interior side 196 and exterior side 198. In one embodiment, door 188 is provided with butt hinges 206 and swings either inwardly or outwardly. In an alternative embodiment, door 188 is hung on pivot pins of the type shown in FIG. 15 and swings both inwardly and outwardly.

Figure 14:
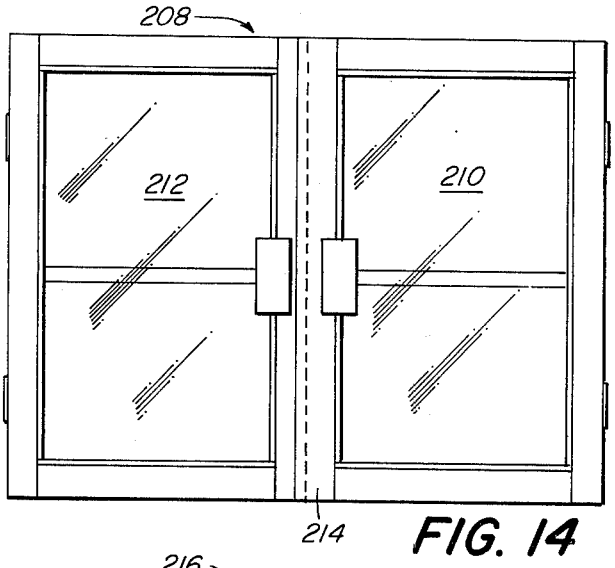
FIG. 14 is a front elevation of another embodiment of the invention.

In the embodiment of FIG. 14, there is shown a double door configuration 208 which swings outwardly and comprises a right hand door 210 and a left hand door 212. Right hand door 210 is similar to door 10 and left hand door is similar to door 188. Right hand door 210 includes a flange 214 which corresponds to flange 46 and overlaps the lead edge stile of door 212 for security and weather protection.

Figure 15:
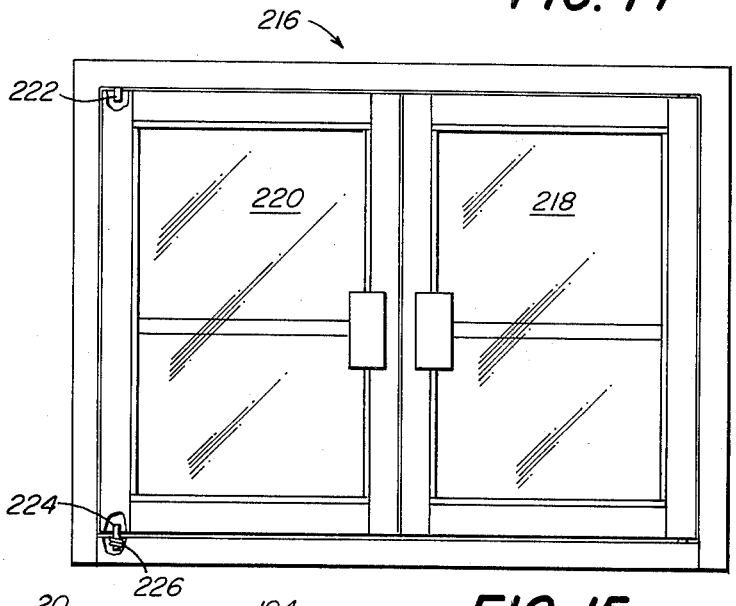
FIG. 15 is a front elevation of yet another embodiment of the invention.

FIG. 15 shows another embodiment in the form of a double door configuration 216 which swings inwardly and outwardly and comprises a right hand door 218 and a left hand door 220, each door being hung on a pair of pins 222 and 224. Pin 222 is fixed to a door frame 226 and pin 224 is spring loaded to door frame 226.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An adjustable entrance door comprising:

a. a plurality of extruded sections including a lead edge stile, a hinge stile, a top rail and a bottom rail;

b. means for interconnecting said sections, said interconnecting means including a pair of tie rods, one of said tie rods connecting said lead edge stile, said hinge stile and said top rail, said other tie rod connecting said lead edge stile, said hinge stile and said bottom rail, said connected sections defining a substantially rectangular open frame;

c. a substantially rectangular panel configured to be received within said frame;

d. means for mounting said panel to said frame, said mounting means including a first pair of shims and a second pair of shims, one shim of said first pair disposed between one of said stiles and said panel adjacent a first corner of said frame, the other shim of said first pair disposed between one of said rails and said panel adjacent said first corner, one shim of said second pair disposed between the other of said stiles and said panel adjacent a second corner of said frame, the other shim of said second pair disposed between said other of said rails and said panel adjacent said second corner, said first corner diagonally opposite said second corner, said first and second pairs of shims positioned so that said panel is mounted oblique to the inner faces of said rectangular frame;

e. first adjusting means mounted to said top rail in engagement with a top edge of said glass panel, said first adjusting means operative to cause relative vertical movement between said lead edge stile and said hinge stile; and f. second adjusting means mounted to said bottom rail, said second adjusting means constrained against free movement relative to said bottom rail and constrained for forced movement relative to said bottom rail, said second adjusting means operative to vary the height of said door when moved relative to said bottom rail.

2. The adjustable entrance door as claimed in claim 1 wherein said other shim of said first pair is closer to said first corner than said one shim of said first pair and said other shim of said second pair is closer to said second corner than said one shim of said second pair.

3. The adjustable entrance door as claimed in claim 2 wherein said first adjusting means includes a block and screw means for moving said block, said top rail formed with an opening, said block mounted to said top rail adjacent said other shim of said first pair, a portion of said block projecting through said opening in said top rail into engagement with a top edge of said panel, said screw means projecting inwardly of said top rail into engagement with said block disposed within said top rail, said movement of said block resulting relative vertical movement of said lead edge stile and said hinge stile.

4. The adjustable entrance door as claimed in claim 1 wherein said bottom rail is formed with a substantially U-shaped channel at its lower side, said U-shaped channel opened at the lower side of said bottom rail, said lead edge stile and said hinge stile formed with corresponding U-shaped channels at the lower margins of their inner sides, said bottom rail channel in registration with said lead edge stile and hinge stile channels when said sections are connected, said second adjusting means including a base and a pair of legs defining a substantially U-shaped profile in right cross section, said legs of said second adjusting means inserted into and snugly received in said bottom rail, lead edge stile and hinge stile channels, said base closing said U-shaped channel.

5. The adjustable entrance door as claimed in claim 1 wherein said panel is composed of glass and wherein said panel mounting means includes pairs of interlocking glazing beads, each of said lead edge stile, hinge stile, top rail and bottom rail formed with a mortise on their inner faces, one of each said glazing bead pairs configured to be snap fitted into each of said mortises, the other of each said glazing bead pairs configured to be snap fitted into locking engagement with each of said one glazing bead pairs, said glass panel captively held by said glazing bead pairs.

6. The adjustable entrance door as claimed in claim 5 wherein said means for interconnecting said sections includes bracket means for supporting said top rail and said bottom rail, said bracket means includes a bracket at each end of said top rail and said bottom rail, each said bracket having a base and a pair of parallel legs that extend outwardly from one side of said base in perpendicular relationship thereto, a flaring tenon formed on the other side of said base, said tenons received within said lead edge stile and said hinge stile mortises to form dovetail joints, said extending legs configured to be snugly received within said lead edge stile and said hinge stile.

7. The adjustable entrance door as claimed in claim 6 wherein the upper and lower margins of said lead edge stile and said hinge stile at the inner side thereof are formed with a hole and wherein said base of each said bracket is formed with a through hole, said lead edge stile and said hinge stile holes in registration with said through holes in said brackets when said brackets are mounted to said lead edge stile and said hinge stile, said tie rods received in said holes in said lead edge stile and said hinge stile and said through holes in said brackets.

8. An adjustable entrance door configured to be hung on a door frame, said entrance door comprising:

a. a plurality of extruded sections including a lead edge stile, a hinge stile, a top rail and a bottom rail, said lead edge stile having a generally trapezoidal profile in right cross section with a flange extending from an outer exterior corner thereof parallel to the exterior side of said entrance door, said flange overlapping a doorjamb of the door frame when said entrance door is closed for security and weather protection, said hinge stile having a substantially trapezoidal profile in right cross section, said top rail having a double I beam profile in right cross section with a shallow U-shaped channel at an outer side thereof, and said bottom rail having a substantially A-shaped profile in right cross section with a deep U-shaped channel at an outer side thereof;

b. means for interconnecting said extruded sections to form a substantially rectangular frame that is configured to be received in the door frame;

c. a substantially rectangular glass panel configured to be received within said rectangular frame;

d. means for mounting said glass panel in said rectangular frame, said mounting means including a first pair of shims and a second pair of shims, one shim of said first pair disposed between one of said stiles and said glass panel adjacent a first corner of said frame, the other shim of said first pair disposed between one of said rails and said glass panel adjacent said first corner, one shim of said second pair disposed between the other of said stiles and said glass panel adjacent a second corner of said frame, said other shim of said second pair disposed between the other of said rails and said glass panel adjacent said second corner, said first corner diagonally opposite said second corner, said first and second pairs of shims positioned so that the edges of said rectangular glass panel are disposed oblique with respect to the inner sides of said rectangular frame;

e. first adjusting means mounted to said top rail, said first adjusting means including a lever and a mover, said top rail formed with a hole through which at least a portion of said lever projects in engagement with an upper edge of said glass panel, said mover in engagement with said lever and available at an outer side of said top rail, said first adjusting means operative to cause relative vertical movement between said lead edge stile and said hinge stile; and f. second adjusting means mounted within said deep U-shaped channel of said bottom rail, said second adjusting means constrained against free movement relative to said bottom rail and constrained for forced movement relative to said bottom rail.

9. The adjustable entrance door as claimed in claim 8 wherein said means for mounting said glass panel includes a pair of interlocking glazing beads, each of said lead edge stile, hinge stile, top rail and bottom rail formed with a mortise on their inner sides, one of each said glazing bead pairs configured to be snap fitted into each of said mortises, the other of each said glazing bead pairs configured to be snap fitted into locking engagement with each of said one glazing bead pairs, said glass panel captively held by said glazing bead pairs.

10. The adjustable entrance door as claimed in claim 9 wherein said means for interconnecting said extruded sections includes bracket means for supporting said top rail and said bottom rail, said bracket means includes a bracket at each end of said top rail and said bottom rail, each said bracket having a base and a pair of parallel legs that extend outwardly from one side of said base in perpendicular relationship thereto, a flaring tenon formed on the other side of said base, said tenons received within said lead edge stile and said hinge stile mortises to form dovetail joints, said extending legs configured to be snugly received within said lead edge stile and said hinge stile.

* * * * *